US007784203B2

(12) United States Patent
Colligan

(10) Patent No.: US 7,784,203 B2
(45) Date of Patent: Aug. 31, 2010

(54) CALENDAR HANGER DEVICE AND ASSEMBLY INCORPORATING THE SAME

(76) Inventor: Curtis Colligan, 15877 Hwy. 24, Woodland Park, CO (US) 80863

( * ) Notice: Subject to any disclaimer, the term of this patent is extended or adjusted under 35 U.S.C. 154(b) by 0 days.

(21) Appl. No.: 12/498,067

(22) Filed: Jul. 6, 2009

(65) Prior Publication Data

US 2009/0265965 A1 Oct. 29, 2009

Related U.S. Application Data

(62) Division of application No. 10/970,828, filed on Oct. 20, 2004, now abandoned.

(51) Int. Cl.
*G09D 3/04* (2006.01)

(52) U.S. Cl. ..... 40/120; 40/341; 40/357; 40/617

(58) Field of Classification Search ..... 40/120, 40/122, 757, 658, 341, 357; 248/447.1, 452, 248/447, 456; 116/235, 240; 283/45
See application file for complete search history.

(56) References Cited

U.S. PATENT DOCUMENTS

| | | | | |
|---|---|---|---|---|
| 196,027 | A | 10/1877 | Lewis | |
| 755,837 | A * | 3/1904 | Barker | 434/162 |
| 814,163 | A | 3/1906 | Pursell | |
| 1,347,729 | A * | 7/1920 | Wride | 434/162 |
| 2,010,102 | A | 8/1935 | Magnus et al. | |
| 2,027,563 | A | 1/1936 | Spinner et al. | |
| 3,352,572 | A * | 11/1967 | Swenson | 283/45 |
| 3,370,367 | A | 2/1968 | Stratton et al. | |
| 3,909,968 | A | 10/1975 | Bolstad | |
| 4,628,572 | A | 12/1986 | Chang | |
| 5,123,191 | A | 6/1992 | Kim | |
| 5,243,777 | A | 9/1993 | Dedlow | |
| 5,297,814 | A * | 3/1994 | Peters | 281/45 |
| 5,339,546 | A | 8/1994 | Rahwan | |
| 6,574,894 | B1 | 6/2003 | Hamilton | |

* cited by examiner

*Primary Examiner*—Joanne Silbermann
*Assistant Examiner*—Christopher E Veraa
(74) *Attorney, Agent, or Firm*—Holland & Hart LLP

(57) ABSTRACT

The present invention relates to hanger devices to secure a tablet to a post-like support member on an upright support surface. The hanger device includes an elongated header portion, a flap panel portion extending therefrom, and an attachment element to secure the tablet. The header portion includes an opening such as an elongate slot or a plurality of bores. The support member is selectively positionable along the length of the slot or in the bores such that the tablet is suspended under the force of gravity in a skewed orientation relative to the support surface. A pouch may be securable to the panel portion so as to be interposed between it and the tablet. The present invention also relates to a calendar assembly that incorporates the hanger device as well as a calendar having a header portion allowing it to be supported in a skewed orientation.

19 Claims, 5 Drawing Sheets

CALENDAR HANGER DEVICE AND ASSEMBLY INCORPORATING THE SAME

FIELD OF THE INVENTION

The present invention generally relates to hanger devices. More particularly, the present invention is directed to hanger devices useful for hanging tablets or calendars on upright support surfaces, such as walls. The present invention is specifically directed to calendars and calendar assemblies adapted to be ergonomically oriented relative to a support surface.

BACKGROUND OF THE INVENTION

Many individuals enjoy decorating personal areas with articles that appeal to them. In many cases, homes and work areas are adorned with plants, pictures of loved ones, artwork, degrees or personal achievement awards, and wall tapestries, to name a few. Oftentimes, certain areas within the home or office are designated for placing important reminders and organizing information relating to future dates. Perhaps the most common way of marking time is with a calendar.

Typically, calendars and calendar devices are organized to present a complete year, a month of the year, a week of the year or a single day. Many calendars are adapted to receive information placed thereon as reminder of events, appointments, or other notational information. As such, calendars are commonly found in an area where they are both conspicuous and easily accessible, and can be found hanging from a wall, a door, or other vertical support surface.

Many companies that manufacture calendars have strived to create a functional calendar, but also one that will serve a decorative purpose due to their high visibility. As a result, a multitude of calendars are available on the market varying in size, shape, organization, as well as the associated decorative theme. Many calendars found today go beyond providing a simple matrix of rows and columns, and devote space for notations to accommodate the many uses that calendars serve.

Despite the usefulness of these various calendars in receiving written information, a problem exists which has long been unresolved. Due to the anatomy of the human body, most comfortable writing is done on a slant. For right-handed people, it is known that the best writing technique occurs where the writer slants his/her writing away from the body when moving left to right. For left-handed writers, when writing left to right, writing is slanted toward the body. Existing calendars, especially those hung from a vertical support surface, have failed to recognize this need. As a result, writing directly onto the calendars has been equally inconvenient for both right and left handed writers. The present invention is directed to meeting this need.

SUMMARY OF THE INVENTION

An object of the present invention is to provide a new and useful calendar that is better adapted for use in writing information thereon.

Another object of the present invention is to provide a device for mounting articles, such as a calendar, to a vertical support surface.

Yet another object of the present invention is to provide a new and useful calendar assembly that can be oriented to favor either a right-handed or left-handed writer so as to be more ergonomic when used to receive written information.

A still further object of the present invention is to provide a new and useful calendar that can be reused month after month, and that may be ergonomically oriented.

According to the present invention, then, a hanger device is provided that is adapted to secure a tablet to a post-like support member disposed on an upright support surface. The hanger device includes an elongated header portion having a front, a back, opposite ends, and a header thickness measured between the front and back thereof. The header portion has a longitudinally extending base axis, which defines a longitudinal direction, as well as a central transverse axis that is generally perpendicular to the base axis and located medially between said opposite ends.

The header portion has an opening formed therethrough that is adapted to engage the post-like support member and may further be provided with a cover layer adhered to the front. The opening could be a bore or an elongate slot extending in the longitudinal direction and wherein the support member is selectively positionable along the slot. Additionally, the slot may be associated with a positioning notch or a plurality of positioning notches that are sized and adapted to receive the support member. Some of the positioning notches may be located offset from the central transverse axis and equidistantly spaced therefrom. Other ones of the positioning notches may lie generally on the central axis.

The hanger device also includes a flat panel portion extending from the header portion that has a thickness less than the header thickness. Both the header portion and the panel portion may be formed of a material selected from the group consisting of cardboard, wood, metal, and plastic.

The hanger device is also provided with a means for releasably attaching a tablet thereto such that when the tablet is secured thereto, at least some of the panel portion forms a backing therefor. Alternatively, when the tablet is secured thereby, and the support member engages an opening that is offset from the central axis, the tablet is suspended under the force of gravity in a skewed orientation relative to the support surface.

The means for attaching the tablet may be accomplished by a primary attachment element supported either by the header portion or the flat panel portion. The primary attachment element is adapted to secure the tablet thereto whereby, when the opening in the header portion engages the post-like support member in a mounted state, the tablet is secured by the attachment element, and at least some of said panel portion forms a backing for the tablet. A secondary attachment element may further be associated with the hanger device. A pouch may be releasably secured to the secondary attachment element. Both the primary and secondary attachment elements may each be selected from the group consisting of adhesive strips, hook and loop fasteners, spring clips, and eyelets and rods.

The present invention is also directed to a calendar assembly adapted to be suspended by a post-like support member disposed on an upright surface. The calendar assembly generally includes a hanger, a calendar, and means for releasably attaching the calendar to the hanger. The hanger may include an elongate header portion and a rectangular flat panel portion extending therefrom and may extend the length of the calendar.

An opening formed in the header portion is adapted to engage the support member at a location offset from the central transverse axis. The calendar includes a grid formed by a plurality of spaced-apart parallel first lines and a plurality of parallel second lines. When the calendar is releasably secured to the attachment means, the opening engages the post-like support member in a mounted state, the first parallel lines run parallel to the base axis and the second parallel lines run parallel to the central transverse axis, whereby said calendar is supported by said hanger in a skewed orientation relative to the support surface under a force of gravity.

The present invention also provides for a calendar adapted to secure to a post-like support member disposed on an upright support surface. The calendar includes an elongated header portion having a front, a back and opposite ends, and a header thickness measured between the front and back thereof. The header has a longitudinally extending base axis and a central transverse axis generally perpendicular to the base axis and located medially between said opposite ends. Further, the header includes an elongate slot adapted to engage the post-like support member whereby said post-like support member is selectively positionable along the length of said opening. The calendar further includes a flat panel portion extending from the header portion and having a panel thickness that is less than the header thickness. Preferably, the panel portion is formed of a reusable material capable of receiving written information. The panel also includes a grid formed thereon, having a plurality of spaced-apart parallel first lines oriented parallel to the base axis and a plurality of spaced-apart parallel second lines oriented parallel to the central transverse axis. Notches may be associated with the slot so that the calendar is selectively oriented.

These and other objects of the present invention will become more readily appreciated and understood from a consideration of the following detailed description of the exemplary embodiments of the present invention when taken together with the accompanying drawings, in which:

BRIEF DESCRIPTION OF THE DRAWINGS

FIG. 1(*b*) is a front view in elevation of the calendar assembly shown in FIG. 1(*a*) tilted to the left for right handed users;

FIG. 1(*c*) is a front view in elevation of the calendar assembly shown in FIG. 1(*a*) tilted to the right for left handed users;

DETAILED DESCRIPTION OF THE EXEMPLARY EMBODIMENTS

The present invention is generally directed to hanger devices that are adapted to be mounted onto an upright support surface. More particularly, the present invention is directed to hanger devices useful for hanging tablets from vertical support surfaces, such as walls, doors, refrigerators and bulletin boards. As used herein, the word "tablet" refers to a plurality of sheets of paper fastened, or otherwise bound together, upon which written information or notations may be received. Further, use of the word tablet broadly includes a calendar as well as any similar product. As will be appreciated from the discussion below, the hanger devices of the present invention are selectively positionable, while mounted on the support surface, to orient the tablet so as to be more ergonomic when used to receive written information. Additionally, the present invention is directed to calendar assemblies and calendars that incorporate the hanging device of the present invention.

Figure 1A:
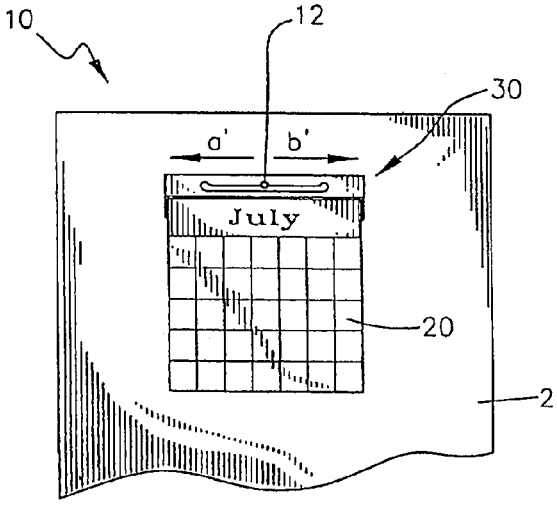
FIG. 1(*a*) is a front view in elevation of a calendar assembly according to a first exemplary embodiment of the present invention, shown mounted to the support in a display orientation.
Figure 1B:
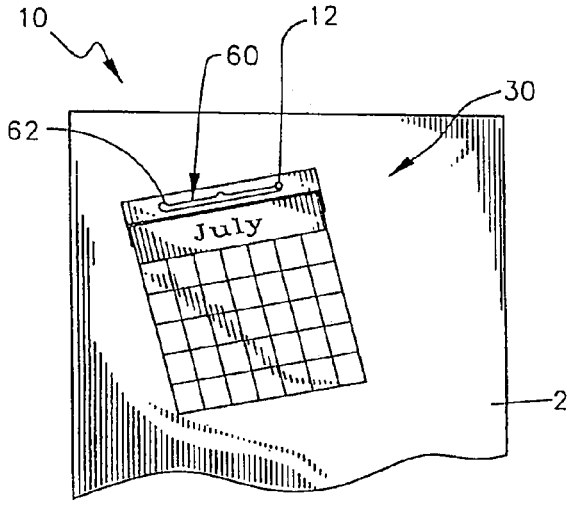
Figure 1C:
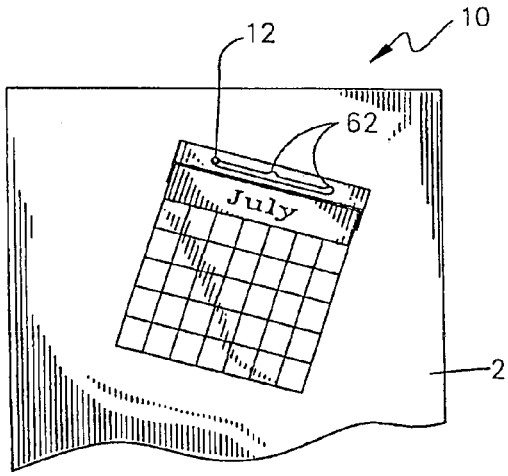

A first exemplary embodiment of the present invention is shown in FIGS. 1(*a*)-1(*c*). Here, it may be seen that calendar assembly 10 is mounted to upright support surface 2 and moveable among the selected orientations illustrated. Generally, calendar assembly 10 includes calendar 20 attached to hanger device 30. Hanger device 30 is suspended by a post-like support member 12, disposed on upright support surface 2. Upright support surface 2 is preferably any vertically oriented surface that is readily accessible by a user, such as a wall, bulletin board, or refrigerator door, to name a few. Post-like support members 12 contemplated include push-pins, nails, thumbtacks, hooks, magnets, and other suitable items that can be disposed on the support surface and that are sufficient to support the weight of the assembly.

Figure 3:
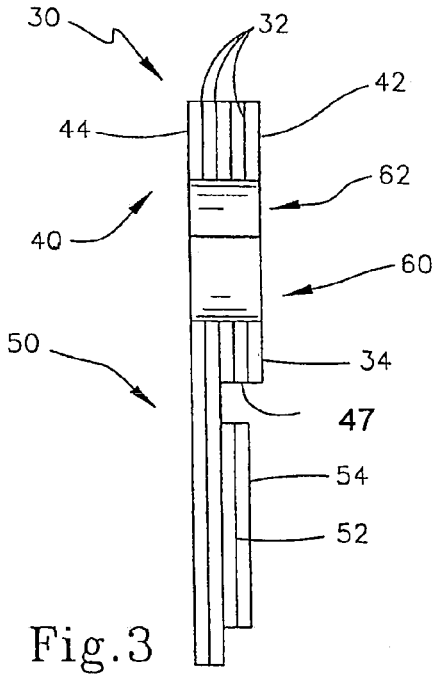
FIG. 3 is a cross-sectional view of the hanger device shown in FIG. 2 taken about lines 3-3.
Figure 2:
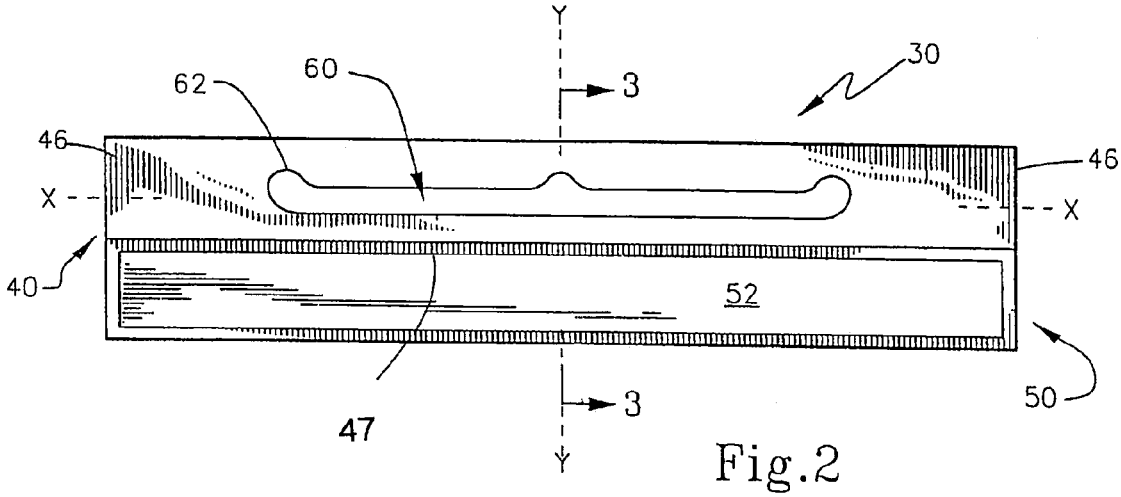
FIG. 2 is a front view in elevation of the hanger device according to a first exemplary embodiment, which forms part of the calendar assembly shown in FIGS. 1(*a*)-1(*c*)

Before illustrating the movement of calendar assembly 10 to arrive at the selected orientations, it is perhaps first useful to have an understanding of the structure associated with hanger 30. Accordingly, reference is now made to FIGS. 2 and 3, which show hanger assembly 30. Hanger assembly 30 includes an elongate header portion 40 and flat panel portion 50 that may be formed as an integral one-piece extension thereof. Both header portion 40 and panel portion 50 may be formed of a plurality of cardboard pieces 32 bound together by known processes, such as lamination. These could be discrete laminated layers or an integral layer folded about itself to arrive at a desired thickness. If desired, header portion 40 may further include cover layer 34 adhered to front 42 whereby decorative indicia may be provided.

Header portion 40 has a front 42, a back 44, opposite ends 46, a lower edge 47, and a thickness that is greater than that of panel portion 50. Header portion 40 has a longitudinally extending base axis "X", which defines a longitudinal direction, and a central transverse axis "Y" located medially between opposite ends 46. Opening 60, shown here in the form of an elongate slot extending in the longitudinal direction, is formed through header portion 40 and further may be associated with a three registration notches 62. Here, three registration notches 62 are provided wherein a first registration notch 62 lies on the central transverse axis "Y" and the second and third registration notches 62 are offset and equidistantly spaced therefrom.

Flat panel portion 50, extending from header portion 40, includes a means for attaching an article, such as a tablet thereto. Here, the attachment element is in the form of adhesive strip 52, which includes peel back strip 54. The tablet is preferably releasably securable to panel portion 50 so that the tablet may be discarded after use. However, panel portion 50 may be provided with a more permanent means of attaching the tablet thereto, if so desired. Alternative attachment elements are discussed below, but may include cooperating hook and loop fastener strips, clips, and a rod received by eyelets.

Both header portion 40 and flat panel portion 50 are preferably constructed of a material suitable to both be suspended by a post-like support member and to support a tablet comprised of a plurality of sheets. Examples of material suitable for this task include cardboard, wood, metal, and plastic, although other suitable materials such as known in the industry are contemplated.

Now with the structure of hanger device 30 in mind, and returning to FIGS. 1(*a*)-1(*c*), it should be understood that calendar 20 has been releasably attached to the flat panel portion of hanger 30 by an attachment element in the form of an adhesive strip whereby at least some of the panel portion forms a backing for the calendar. Support member 12 is received in slot 60 and registered in a selected one of notches 62. As shown, support member 12 may travel within slot 60 so as to register with any of the registration notches 62 that are associated therewith. Movement of support member 12 in this way enables calendar 20 to be skewed relative to the support surface to accommodate right-handed or left-handed writers. By way of illustration, calendar assembly 10 may first be oriented in a display orientation, as shown in FIG. 1(*a*), whereby calendar 20 is not askew of the vertical support surface. Movement of calendar assembly 10 in the direction of arrow "a" causes support member 12 to travel in slot 60 to an adjacent notch 62, a location offset of the central transverse axis whereby calendar 20 is suspended under the force of gravity in a skewed orientation relative to the support surface 2. The orientation of calendar 20, as shown in FIG. 1(*b*), is expected to assist right-handed persons when writing information thereon.

In the alternative, movement of calendar assembly 10 from the display orientation in the direction of arrow "b" causes support member 12 to travel along slot 60 to an adjacent notch 62, a location offset of the central transverse axis whereby calendar 20 is suspended under the force of gravity in a skewed orientation relative to the support surface 2. The orientation of calendar 20, as shown in FIG. 1(*c*), is expected to assist left-handed persons when writing information thereon.

Figure 4:
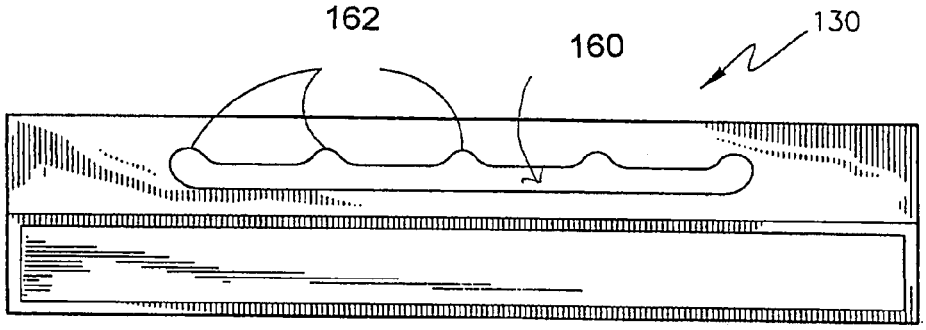
FIG. 4 is a front view in elevation of a second exemplary embodiment of the hanger device according to the present invention.

Alternative hanger devices are shown in FIGS. 4-9. More particularly, FIG. 4 shows a hanger device 130 according to a second exemplary embodiment of the present invention. Here, hanger device 130 is constructed similarly to that of hanger device 30 described above, with the exception that slot 160 is associated with five registration notches 162 rather than three notches. Use of additional notches 162 permits the additional registration locations of a post-like support member along the slot.

Figure 5:
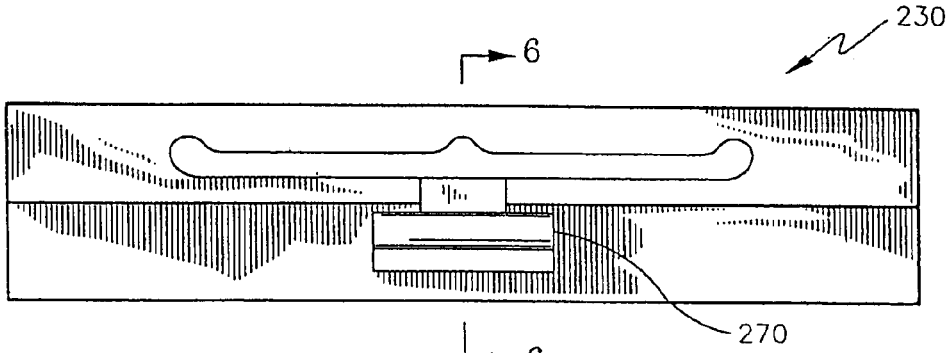
FIG. 5 is a front view in elevation of a third exemplary embodiment of the hanger device according to the present invention.
Figure 6:
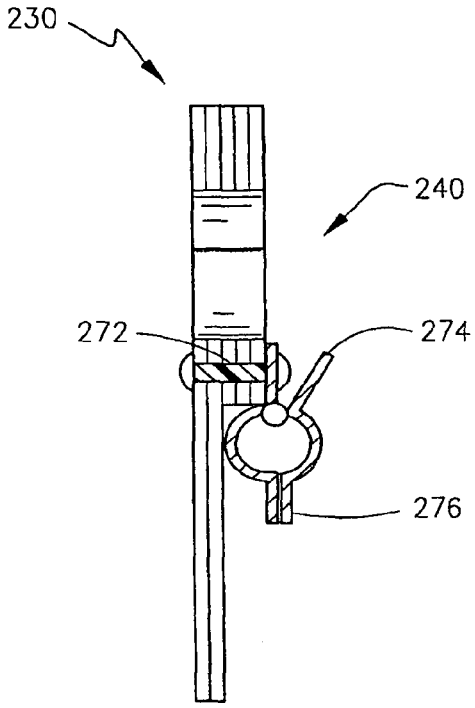
FIG. 6 is a cross-sectional view of the hanger device shown in FIG. 5 taken about lines 6-6.

FIGS. 5 and 6 show a hanger device 230 according to a third exemplary embodiment of the present invention. Hanger device 230 is also similar in construction to that of hanger device 30, but additionally includes an attachment element in the form of spring clip 270. Clip 270 provides an alternative means to the adhesive strip whereby tablets may be coupled to the hanger devices so as to be supported thereby. Clip 270 is mounted to header portion 240, for example, with mounting rivet 272 and is similar in construction to a common binder clip, and includes clip handles 274 and jaw 276. Clip 270 is an alternative attachment element whereby a tablet, calendar, writing pad or other desired writing article may be clamped to hanger device 230 by means thereof.

Figure 8:
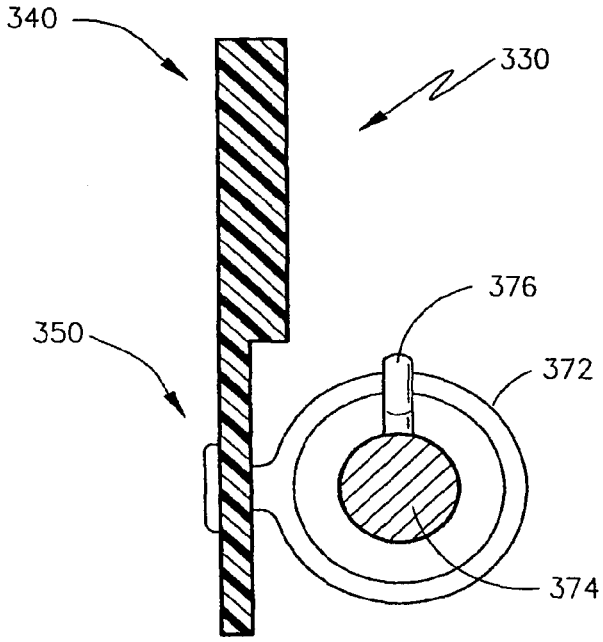
FIG. 8 is a cross-sectional view of the hanger device shown in FIG. 7 taken about lines 8-8.
Figure 7:
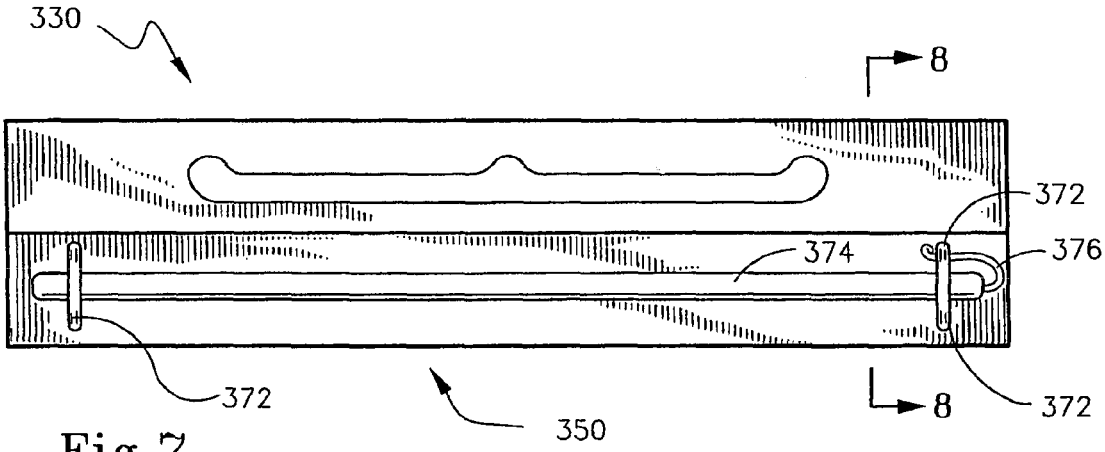
FIG. 7 is a front view in elevation of a fourth exemplary embodiment of the hanger device according to the present invention.

A fourth exemplary embodiment of the hanger device according to the present invention is shown in FIGS. 7 and 8. Hanger device 330 is provided with an attachment member in the form of a pair of spaced-apart eyelets 372 mounted to flat panel portion 350. Rod 374 is sized and adapted to be received through eyelets 372 so as to extend therebetween. Rod 374 is further releasably fastened to one of eyelets 372 with spring clip 376, although other suitable means known in the industry are also contemplated. Eyelets 372 and rod 374 are operative as an alternative means for attaching a tablet to the hanger device. Preferably, for use of this attachment means, the tablet has a spiral binding that is sized and adapted to receive rod 374 therethrough. Accordingly, rod 374 may be fed through the spiral binder of the tablet and further received by each eyelet 372, and the rod may be retained in place by spring clip 376. Further, it should be noted that in this particular embodiment, header portion 340 and flat panel portion 350 are formed as an integral one-piece plastic construction, such as by injection molding.

Figure 9:
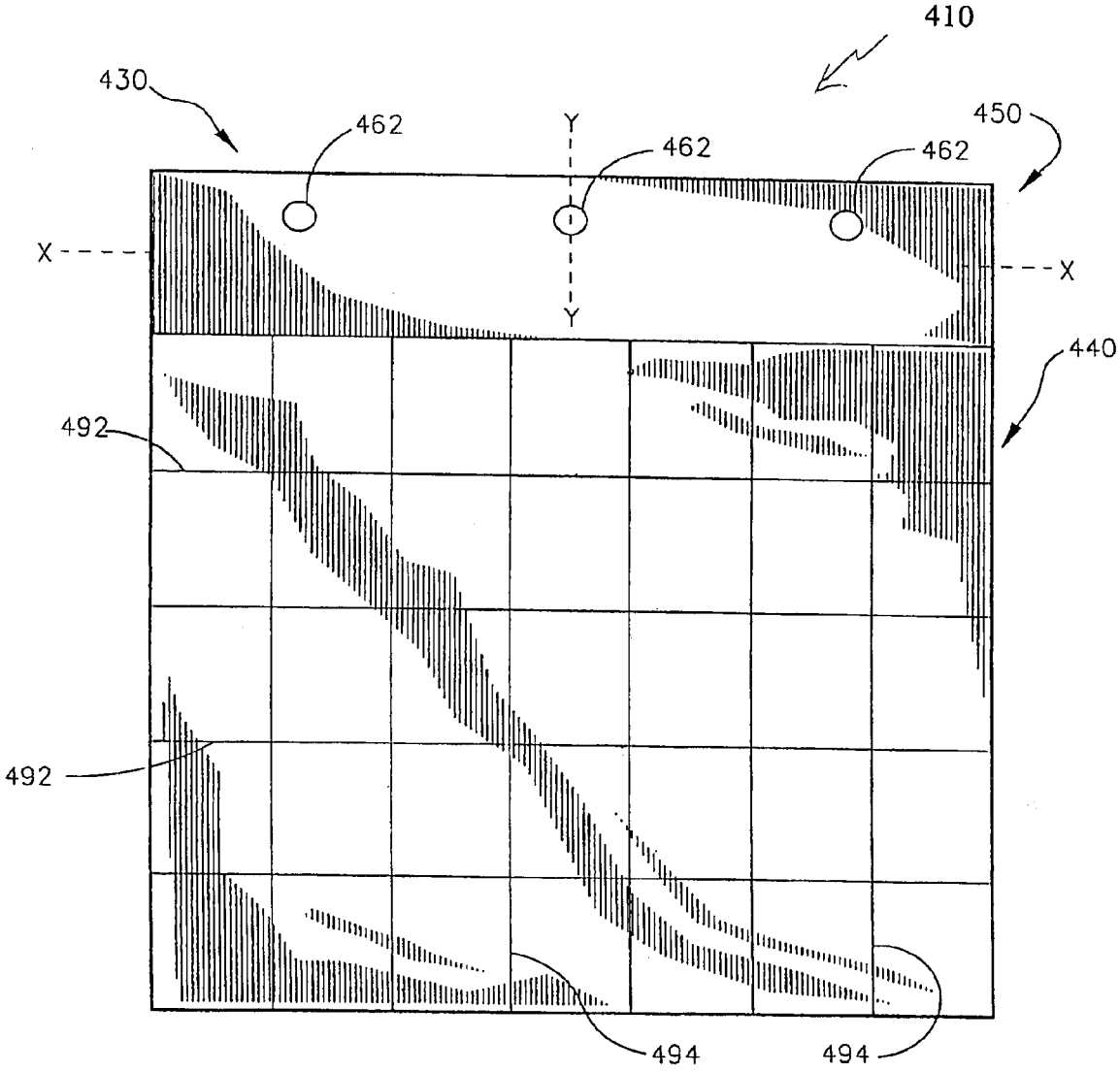
FIG. 9 is a front view in elevation of an alternative calendar assembly according to the present invention.

An alternative calendar assembly 410 according to the present invention is shown in FIG. 9. Here, header portion 430 includes three bores 462 that are sized and adapted to receive a post-like support member. Two of bores 462 are positioned offset from the central transverse axis "Y", while the central bore lies on the central transverse axis "Y".

As compared to the header portions heretofore described, header portion 430 does not include a slot or other opening interconnecting bores 462. In addition, as shown, flat panel 440 is sized and configured as a calendar and has a grid formed thereon, including a plurality of spaced-apart parallel first lines 492 oriented parallel to the base axis "X" and a plurality of spaced-apart parallel second lines 494 oriented parallel to the central transverse axis "Y". Flat panel 440 is preferably made of a reusable material, such as a laminated sheet, so that written information provided thereon can be erased or removed such that flat panel 540 is reusable.

Figure 10:
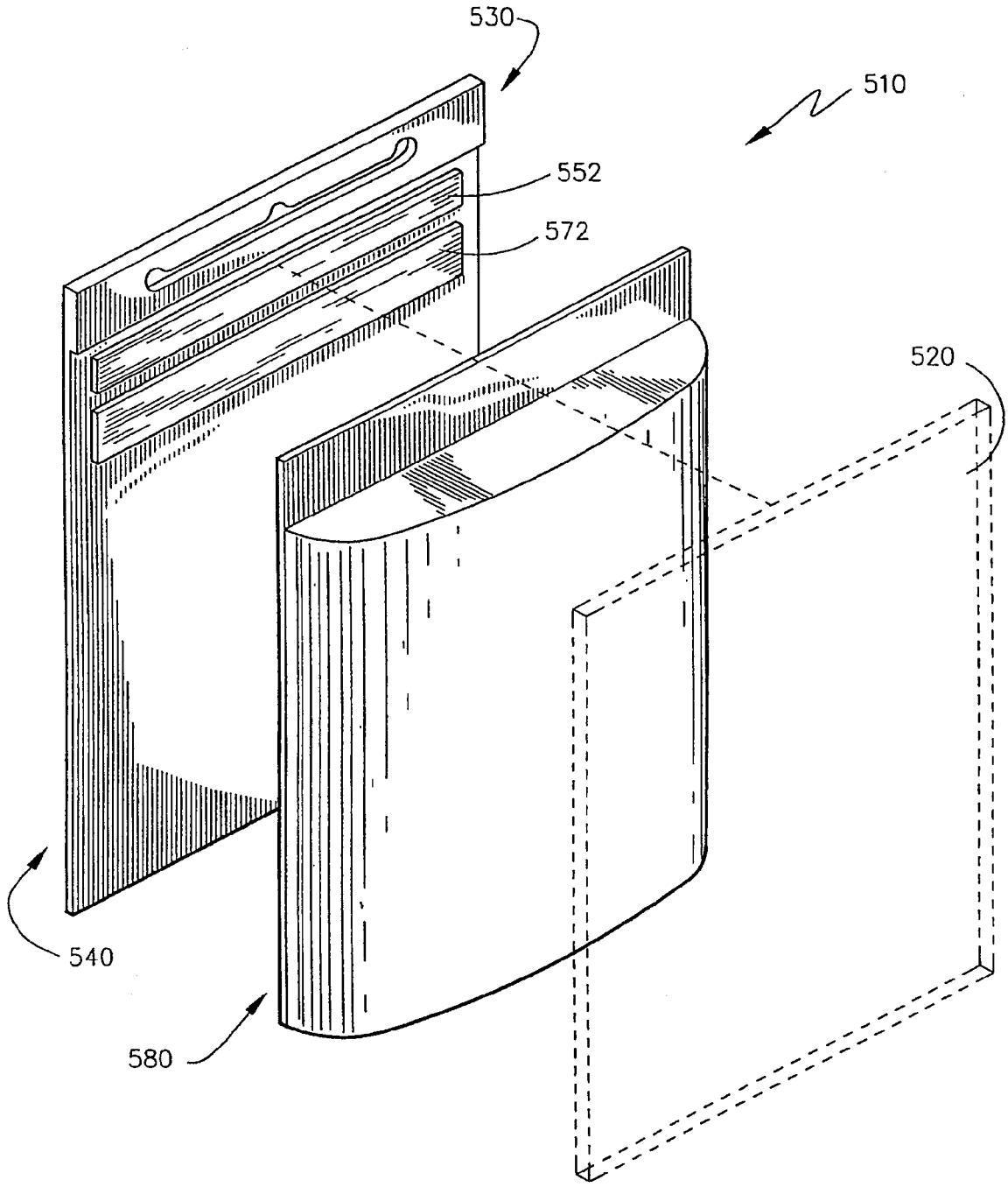
FIG. 10 is a perspective view of yet another calendar assembly according to the present invention.

An alternative calendar assembly 510 is shown in FIG. 10. Here, calendar assembly 510 includes calendar 520, shown in phantom, hanger device 530, and pouch 580. Hanger device 530 includes a primary attachment element 552 and a secondary attachment element 572, both of which are adhesive strips disposed on flat panel portion 540. Calendar 520 is adapted to be mounted to flat panel portion 540 by means of first attachment element 552. As shown here, flat panel portion 540 is similar in size and shape to calendar 520. Pouch 580 is adapted to be interposed between calendar 520 and flat portion 540 and is mounted to flat panel portion 540 by means of second attachment element. Pouch 580 may be used to store discarded pages from calendar 520, writing implements, receipts, notes, or other desired articles.

As should be appreciated from the foregoing, any one of the alternative hanger devices may be used with a selected tablet. Further, any one of the foregoing attachment elements may be provided with any one of the above-described hanger devices.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

What is claimed is:

1. A method for suspending a tablet assembly by a post-like support member disposed on an upright support surface, comprising:

(A) providing a tablet assembly, including (1) an elongated header portion having a front, a back, opposite ends, and a lower edge, and having a longitudinally extending base axis defining a longitudinal direction and a central transverse axis generally perpendicular to the base axis and located medially between said opposite ends, said header portion having an opening formed therethrough that is adapted to engage the post-like support member at a location offset from the central transverse axis;

(2) a rectangular flat panel portion extending from said header portion; and (3) a tablet attached to said panel portion and having a plurality of spaced-apart parallel lines that run parallel to the base axis;

(B) positioning said opening over the post-like support member; and (C) suspending said tablet assembly from the post-like support member in a tilted orientation such that said parallel lines are skewed relative to the support surface thereby providing an ergonomic orientation for writing on said tablet.

2. The method according to claim 1 including writing on said tablet when in the tilted orientation and thereafter orienting said tablet assembly in a level orientation such that said parallel lines are horizontal relative to said support surface.

3. The method according to claim 1 wherein said opening is an elongate slot and wherein the post-like support member protrudes through said slot in a location offset from said central transverse axis.

4. The method according to claim 3 including sliding the post-like support member within said slot from a location aligned with said central transverse axis to said location offset from said central transverse axis.

5. The method according to claim 3 wherein said elongate slot includes at least one positioning notch that is sized and adapted to receive the support member, and including positioning said notch on the support member.

6. The method according to claim 5 wherein a first one of said notches and a second one of said notches are each offset from the central transverse axis and equidistantly spaced therefrom, and including positioning one of said first and second notches on the support member.

7. A method for suspending a calendar by a post-like support member disposed on an upright support surface, comprising:

(A) providing a calendar, including (1) an elongated header portion having a front, a back and opposite ends, and a header thickness measured between the front and back thereof, said header portion having a longitudinally extending base axis and a central transverse axis generally perpendicular to the base axis and located medially between said opposite ends, said header portion having an elongate slot opening formed therethrough and adapted to engage the post-like support member whereby said post-like support member is selectively positionable along the length of said opening;

(2) a flat panel portion extending from said header portion and having a panel thickness that is less than the header thickness, said panel portion including a material capable of receiving written information; and (3) a grid formed on said flat panel portion having a plurality of spaced-apart parallel first lines oriented parallel to the base axis and a plurality of spaced-apart parallel second lines oriented parallel to the central transverse axis;

(B) positioning said opening over the post-like support member; and (C) suspending said calendar from the post-like support member in a tilted orientation such that said parallel first lines are skewed relative to the support surface thereby providing an ergonomic orientation for writing on said panel portion.

8. The method according to claim 7 including writing on said calendar when in the tilted orientation and thereafter orienting said calendar in a level orientation such that said parallel first lines are horizontal relative to said support surface.

9. The method according to claim 8 wherein said elongate slot includes a central notch that lies on the central transverse axis, and including engaging said central notch with the post-like support member when said hanger is oriented in the level orientation.

10. The method according to claim 7 including sliding said post-like support member towards the right side of said slot, thereby providing an ergonomic orientation for writing on the calendar by a right-handed person.

11. The method according to claim 7 including sliding said post-like support member towards the left side of said slot, thereby providing an ergonomic orientation for writing on the calendar by a left-handed person.

12. The method according to claim 7 including sliding the post-like support member within said slot from a location aligned with said central transverse axis to a location offset from said central transverse axis.

13. The method according to claim 7 wherein said elongate slot opening includes a positioning notch that is sized and adapted to receive the support member wherein said positioning notch is offset from the central transverse axis, and including positioning said notch on the support member.

14. The method according to claim 13 wherein a first one of said notches and a second one of said notches are each offset from the central transverse axis and equidistantly spaced therefrom, and including positioning one of said first and second notches on the support member.

15. A method of suspending a tablet from a post-like support member disposed on an upright support surface and recording information thereon, the tablet including a plurality of spaced apart parallel lines, the method comprising:

(A) providing a hanger, including (1) an elongated header portion having a front, a back, opposite ends, a lower edge and a header thickness measured between the front and back thereof, said header portion having a longitudinally extending base axis defining a longitudinal direction and a central transverse axis generally perpendicular to the base axis and located medially between said opposite ends, said header portion having an elongate slot formed therethrough that extends in the longitudinal direction wherein the post-like support member is selectively positionable along the slot;

(2) a flat panel portion extending from said header portion and having a panel thickness that is less than the header thickness; and (3) an attachment element supported by said panel portion and adapted to secure a tablet thereto;

(B) attaching a tablet to said hanger, whereby the tablet is located entirely below the lower edge of said header such that the parallel lines run parallel to said base axis;

(C) positioning said elongate slot over the post-like support member;

(D) suspending the hanger from the post-like support member in a tilted orientation such that the parallel lines are skewed relative to the support surface thereby providing an ergonomic orientation for writing on the tablet; and (E) writing on the tablet when in the tilted orientation and thereafter orienting the tablet in a level orientation such that the parallel lines are horizontal relative to the support surface.

16. The method according to claim 15 including sliding the post-like support member within said slot from a location aligned with said central transverse axis to a location offset therefrom.

17. The method according to claim 16 including sliding said post-like support member towards the right side of said slot, thereby providing an ergonomic orientation for writing on the tablet by a right-handed person.

18. The method according to claim 16 including sliding said post-like support member towards the left side of said slot, thereby providing an ergonomic orientation for writing on the tablet by a left-handed person.

19. The method according to claim 15 wherein said elongate slot includes a central notch that lies on the central transverse axis, and including engaging said central notch with the post-like support member when said hanger is oriented in the level orientation.

* * * * *